US005199188A

United States Patent [19]

Franz

[11] Patent Number: 5,199,188

[45] Date of Patent: Apr. 6, 1993

[54] METHOD AND APPARATUS FOR DRYING FOOTWEAR AND HANDWEAR

[76] Inventor: Daniel Franz, P.O. Box 2241, Conway, N.H. 03818

[21] Appl. No.: 725,322

[22] Filed: Jul. 8, 1991

[51] Int. Cl.[5] ..... F26B 25/00

[52] U.S. Cl. ..... 34/105; 34/104

[58] Field of Search ..... 34/103, 104, 106, 107, 34/105, 21, 151, 202; 223/78

[56] References Cited

U.S. PATENT DOCUMENTS

| | | | |
|---|---|---|---|
| 208,070 | 9/1878 | Buxton | 34/104 |
| 314,460 | 3/1885 | Meridith | 34/104 |
| 629,944 | 8/1899 | Witmer | 34/104 |
| 680,264 | 8/1901 | Mansfield | 34/104 |
| 859,514 | 7/1907 | Peabody | 34/104 |
| 1,074,888 | 10/1913 | McIver | 34/104 |
| 1,280,445 | 10/1918 | Grace | 34/104 |
| 1,450,033 | 3/1923 | Gowan | 34/104 |
| 2,446,234 | 8/1948 | Lieber | 34/104 |
| 3,203,112 | 8/1965 | Edmonds | 34/104 |
| 3,299,529 | 1/1967 | Roberts et al. | 34/104 |
| 3,513,564 | 3/1968 | Gramprie | 34/104 |
| 3,645,009 | 2/1972 | Ketchum | 34/104 |
| 4,085,519 | 4/1978 | Masika | 34/104 |
| 4,136,464 | 1/1979 | Hay | 34/104 |
| 4,145,602 | 3/1979 | Lee | 34/104 |
| 4,200,993 | 5/1991 | Blanc et al. | 34/104 |
| 4,596,078 | 6/1986 | McCartney | 34/104 |
| 4,727,656 | 3/1988 | Jannach et al. | 34/104 |
| 4,768,293 | 10/1988 | Kaffka | 34/104 |
| 4,787,153 | 11/1988 | Chen | 34/104 |

*Primary Examiner*—Henry A. Bennet
*Assistant Examiner*—Denise Gromada
*Attorney, Agent, or Firm*—Lorraine M. Donaldson

[57] ABSTRACT

A method and apparatus for drying footwear and handwear utilizing a compartment having a blower assembly and a central tube for directing air into a tree-rack for contact with the wet or damp footwear. A second embodiment includes a drying fitting for drying handwear. The apparatus includes a rotating element to ease the installation of the footwear.

6 Claims, 2 Drawing Sheets

METHOD AND APPARATUS FOR DRYING FOOTWEAR AND HANDWEAR

FIELD OF INVENTION

The invention relates to the field of drying footwear, such as shoes, ice skates and ski boots, and handwear, such as gloves and mittens, after they have been wetted.

BACKGROUND

Drying skates, boots, or the like has been recognized as a desirable objective. Specifically, in professional sports, for example, the need to quickly and efficiently completely remove accumulated moisture from the insides as well as the outside of the article to be dried is highly desirable. The state of the art is such that driers cannot remove such moisture without very high volume of super-heated air, thereby compromising the material of the skate or boot.

The present invention presents a uniform drying system, without the disadvantages of the prior art. The wet or moist footwear is thoroughly dried, in a very short time. The device of the present invention utilizes either heated or ambient air to dry the footwear or handwear.

SUMMARY OF THE INVENTION

It is therefore the object of this invention to provide a method and apparatus to dry multiple footwear and handwear. A further object of the invention is to provide an efficient, safe and economical apparatus utilizing heated or ambient air for drying such footwear and handwear. It is further anticipated that the apparatus of the invention can be rotated to ease the installation of the footwear.

According to one embodiment of the invention, a safe and economical way to dry footwear is provided by a compartment having at least four sides and a top and a bottom. This compartment encases a heater with a blower, hereinafter referred to as a blower assembly, which provides heated or ambient air to be used in drying. The air from the blower assembly passes through the top of the compartment and into a central tube which directs the air through arms attached to the central tube in a tree-rack configuration. Each arm has apertures through which air passes to make contact with the footwear. The footwear is mounted on these arms. It is anticipated that a typical ski boot or skate will be dried in one to two hours. A second embodiment of this invention is provided by a compartment having at least four sides and a top and a bottom. The compartment encases a blower assembly which provides heated or ambient air to be used in drying. The provided air passes through the top into a plurality of drying fittings onto which gloves, mittens or any other desired article may be placed. It is anticipated that a typical glove may be dried in one half to one hour. This embodiment also allows for the installation of the means for drying footwear mounted in the same top as the means for drying handwear.

DETAILED DESCRIPTION OF THE DRAWINGS

The apparatus of the present invention includes a multi-holed top, 40, and the vertical air chamber assembly, 12, which is comprised of horizontal support tubes, 12A, with holes, 12B. The handwear holder assembly, 42, is comprised of shoulder, 42A, hole for air passage, 42B, and support wire, 42C. Plugs, 44, are installed in holes, 40A, of top, 40. These plugs are necessary when neither the vertical air chamber assembly, 12, or the handwear holder assemblies, 42,is installed.

The overall height of the apparatus of the invention is from about four feet to ten feet, most preferably from about six feet to about eight feet.

Figure 1:
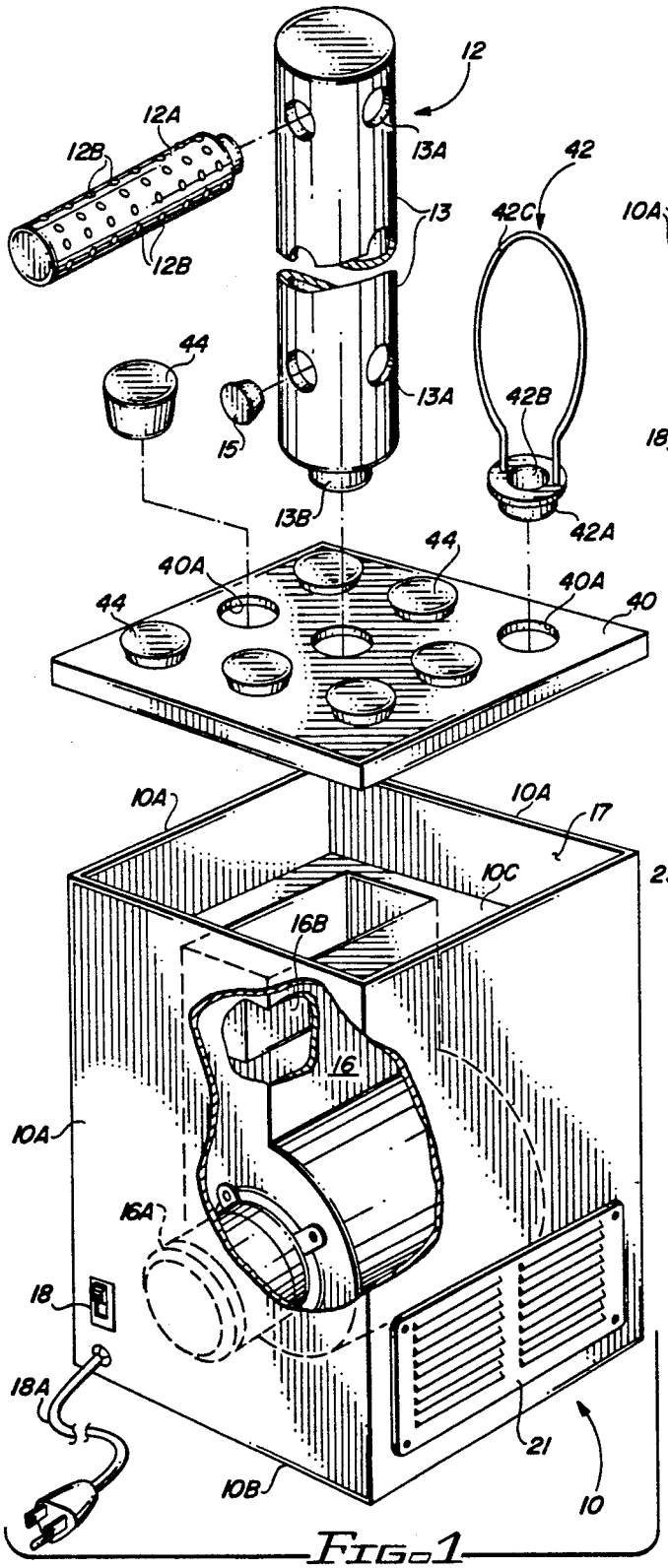
FIG. 1 is an exploded view of the present invention.

FIG. 1 is an exploded view of the present invention, 10, which may be used to dry footwear, handwear, or both, simultaneously. This embodiment consists of a compartment with four sides, 10A, a bottom. 10B, and a multi-holed top, 40. There is an on/off switch, 18, with a 110 VAC power cord/plug mounted on one of the sides, 10A, which supplies power to the blower motor, 16A, and the heating element, 16B. The blower assembly, 16, provides either heated or ambient air to the plenum, 17, which passes the air through the multi-holed top, 40, into either the vertical chamber assembly, 12, or the handwear holder, 42, or both 12 and 42. The holes, 40A, in the multi-holed top, 40, when not in use have plugs installed to prevent air from passing through them. Horizontal boot support tubes, 12A, have a plurality of holes, 12B, to provide air to dry the footwear. The boot support tubes, 12A, are installed into the holes, 13A, of the main vertical tube, 13.

The vertical air chamber assembly, 12, is installed in top, 40, by inserting shoulder, 13B, in a hole, 40A. A plurality of handwear holder assemblies, 42, (dependent upon the number of handwear articles to be dried), are installed in top 40, by inserting shoulder(s), 42A, in hole(s), 40A. A plurality of horizontal support tubes, 12A, (dependent upon the number of footwear to be dried), are installed in holes, 13A, of the vertical chamber assembly, 12. The remaining unfilled holes, 13A, are provided with plugs, 15; such plugs are installed to prevent unnecessary airflow.

The chosen footwear, 22, is installed on horizontal support tubes, 12A, by placing the open end of the footwear over the horizontal support tube, 12A. The chosen handwear, 43, is installed on the handwear holder assemblies, 42, by placing the open end of the handwear over the handwear holder assemblies, 42. Any holes, 40A, that have neither handwear holder assemblies, 42, or the vertical air chamber assembly, 12, installed, are provided with plugs, 44, installed to prevent unnecessary airflow.

In order to ease the installation of footwear and handwear, onto their respective holders, the present invention may be rotated. It is anticipated that rotation would be by conventional means, for example, installing a rotating pivot point.

When all footwear, 22, and handwear, 43, have been placed on the holder assemblies, the blower assembly is turned on at switch, 18. The blower assembly provides either heated or ambient air that dries the footwear and handwear by means of forced convection. The air is forced through holes, 40A, which proceeds through holes, 13A, of the vertical air chamber assembly, 12, and then passes through the plurality of holes, 12B, in the horizontal support tubes, 12A, which then comes in contact with the footwear, 22.

In the handwear embodiment, the air passes through holes, 42B, of the handwear holder assemblies, 42, and comes in contact with the handwear, 43.

The air used for drying enters the lower chamber area, 19, of the chamber assembly, 10, through the intake air grill, 21, which is mounted on one of the sides, 10B, of the chamber assembly, 10. It then proceeds into the blower assembly, 16, where it is either heated or remains at ambient temperature. However, in either state it's velocity is increased between the entrance of the blower assembly and the exit of the blower assembly. The blower assembly, 16, is mounted to one of the sides 10A and to the plenum shelf, 20. This air then enters the plenum, 17, where there is an even distribution to the holes that have either the vertical chamber assembly, 12, installed, or the handwear holder assemblies, 42, installed.

Heated air, 25, may be preferred for shortening the drying time when allowable, (if the installed footwear and handwear will not be adversely affected by heat).

An alternate embodiment of the invention utilizes top, 50, that comprises only one hole into which vertical air chamber assembly, 52, is permanently installed. This vertical air chamber assembly, 52, comprises horizontal support tubes, 53, with holes, 54. There is a heat-resistant gasket, 51, which seals the area where the vertical air chamber assembly, 52, communicates with the top, 50. This embodiment most preferably provides for footwear to be dried, however, handwear may also be dried by installing handwear on the horizontal support tubes, which is performed by the same method as described above.

The chamber assembly tops, 40 and 50, sides 10A, and bottom, 10B, are most preferably made of, but not limited to, wood with a hard plastic covering laminated to the exterior surfaces. Preferably, the chamber assemblies may be made of heat resistant plastic, or metal. Preferably, the dryer chambers, comprising tops, 40 and 50, the sides, 10A, and the bottom, 10B, are from about one foot high, by one foot wide, by one foot deep to about four feet high, by four feet wide, by four feet deep.

The holes, 40A, are from about three inches to about seven inches in diameter. The plenum shelf, 20, is most preferably made of wood with a hard plastic covering laminated to the exterior surfaces. The plenum shelf, 20, may also be made of heat resistant plastic or metal. The plenum shelf, 20, is preferably one square foot to about four square foot and measures from about three-eight's inch thick to about five-eight's inch thick.

The vertical air chamber assemblies, 12 and 52, are most preferably made of, but not limited to, polyvinyl-chloride pipe. It is further anticipated that they may also be made of other grades of heat-resistant plastic, wood or metal. The diameter of the vertical air chamber assemblies, 12 and 52, are from about three inches to about twelve inches, and have lengths from about three feet to eight feet.

The horizontal support tubes, 12A and 53, are most preferably made of, but not limited to, polyvinyl-chloride pipe. It is anticipated that they may also be made of, but not limited to, other grades of heat-resistant plastic, wood or metal. The diameter of the horizontal support tubes, 12A and 53, is from about three-eights inches to about two inches, and the lengths are from about six inches to about twelve inches. The vertical air chamber assemblies, 12 and 52, and the horizontal support tubes, 12A and 53, are preferably off-the-shelf items that may be easily modified by having holes put in by a standard means.

The blower assembly, 16, is most preferably made of, but not limited to, a heat resistant plastic case with metal heating elements, 16B, and a metal motor, 16A. The blower assembly is readily available off-the-shelf and need not have to be specially modified for this application. The intake air grill, 21, is most preferably made of, but not limited to, metal; however it may also be made of plastic. The intake grill measures from about from about three inches square to about six inches square.

The handwear holder assemblies, 42 and 30, are most preferably made of, but not limited to, metal handwear support wires, 31 or 42C, and most preferably made of, but not limited to, polyvinyl chloride shoulders, 32 or 42C. The handwear support wires, 31 and 42C, may also be made of heat-resistant plastic, or metal wire. The shoulders, 32 and 42C, may also be made of wood or metal. These assemblies measure from about two inches at the largest diameter to about four inches at the largest diameter, and have lengths from about six inches to about eight inches.

The main vertical tube, 13, has a shoulder that has a diameter that communicates with the diameter of the holes, 40A, in the multi-hold top. The handwear holder, 42, has a shoulder, 42A, that has a diameter that communicates with a diameter of the holes, 40A, in the multi-holed top.

Figure 2:
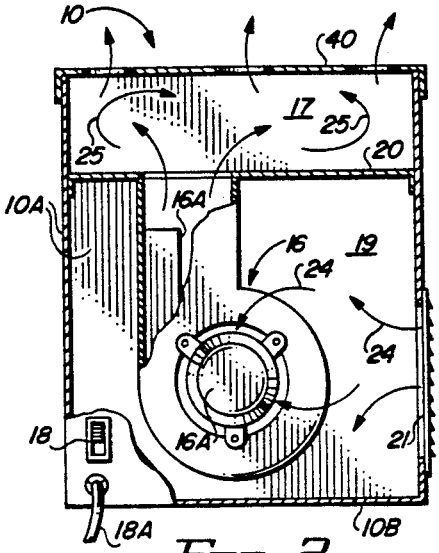
FIG. 2 is a cross-sectional view of the compartment and blower assembly.

FIG. 2 is a side view of the invention showing input air, 24, supplied to the blower assembly, 16, through the intake air grill, 21. The input air, 24, enters the lower chamber, 19, of the compartment and passes into the blower assembly, 16, where it is heated by the heating element, 16B. After the heating cycle it enters the plenum, 17, and continues through the holes, 40A, of the multi-holed top.

Figure 3:
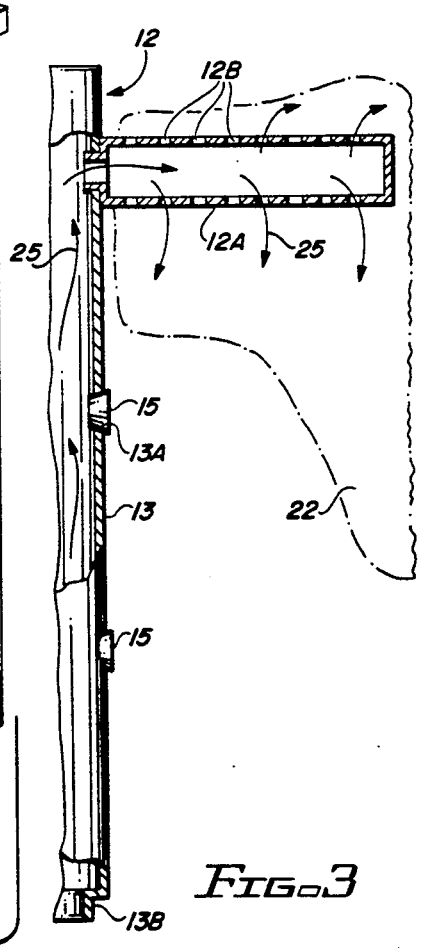
FIG. 3 is a cross-sectional view of the vertical air chamber assembly including a cross-sectional view of an installed horizontal boot drying tube.

FIG. 3 is a cross-sectional view of the vertical air chamber assembly, 12, with the horizontal boot support tube, 12A, installed. Plugs, 15, are installed in unused holes of the main vertical tube, 13, to prevent air from passing through them. Heated air, 25, passes through the main vertical tube, 13, and into the horizontal boot support tube, 12A, through hole, 13A, and then enters the boot, 22, through holes, 12B.

Figure 4:
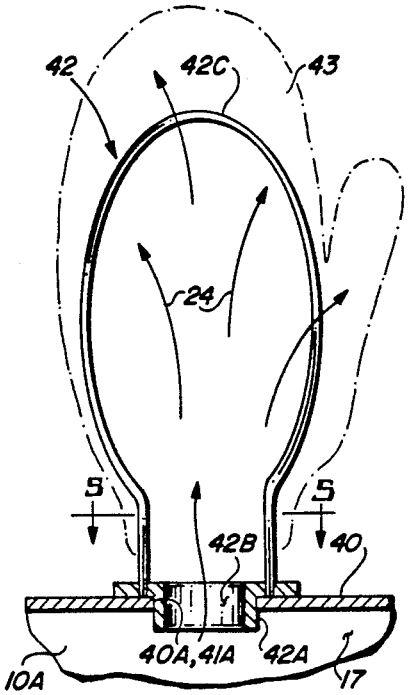
FIG. 4 is a cross-sectional view of the handwear holder installed in a hole of the multi-holed top.

FIG. 4 is a cross-sectional view of the handwear holder, 42, installed in the multi-holed top, 40, by means of the shoulder, 42A, communicating with the inside diameter of the hole 40A.

Figure 5:
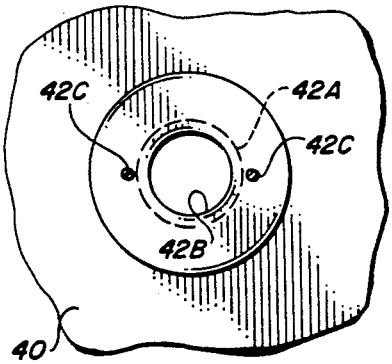
FIG. 5 is a top view of one hole in the multi-holed top with a handwear holder installed.

FIG. 5 is a top view of a hole, 40A. Hole, 40A communicates with the shoulder, 42A, of the handwear holder, 42.

Figure 6:
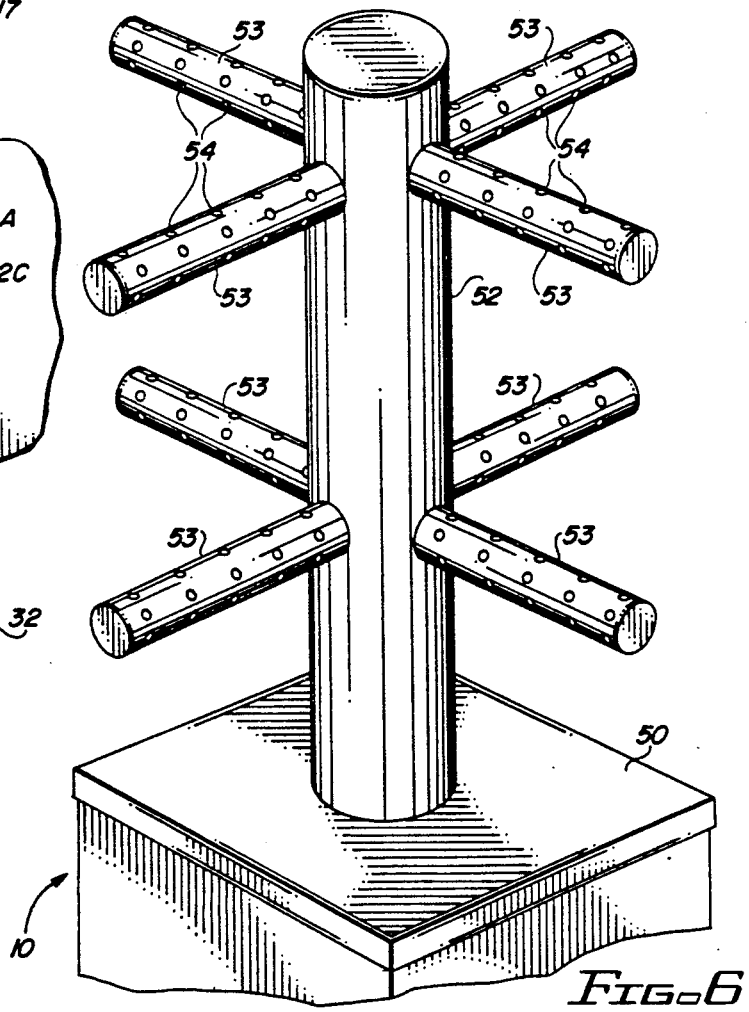
FIG. 6 is a perspective view of the vertical air chamber assembly installed in the single-hole top.

FIG. 6 is a perspective view of an embodiment of the invention that utilizes a top, 50, that has a single hole in which the vertical air chamber assembly, 52, communicates with. This vertical air chamber assembly, 52, is permanently mounted to the top, 50, and the horizontal support tubes, 53, are permanently mounted to the vertical air chamber assembly, 52. The horizontal boot support tubes have a plurality of holes, 54, through which air passes to dry the boot.

Figure 7:
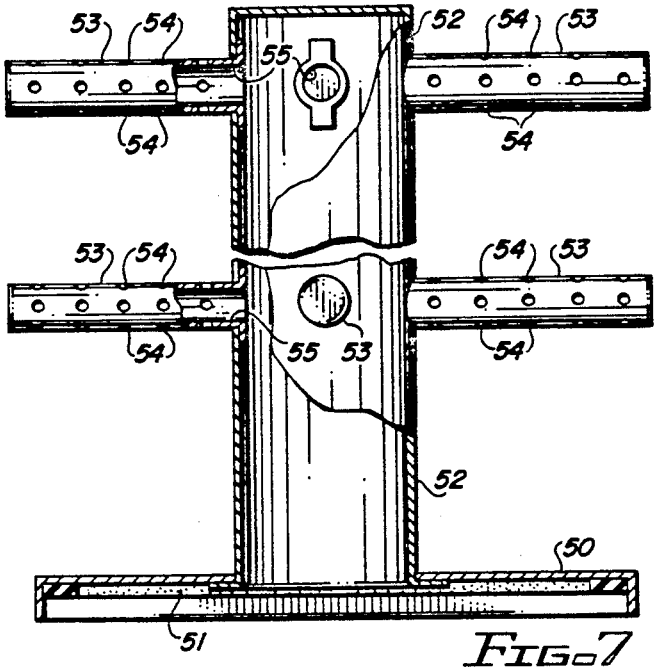
FIG. 7 is a frontal view of the vertical air chamber assembly installed in the single-hole top; and, FIG. 8 is a perspective view of an alternate embodiment of a handwear/footwear holder.

FIG. 7 is a frontal view of the vertical air chamber assembly, 52, permanently mounted to the top, 50, showing the gasket, 51, which prevents air leakage between the top, 50, and the vertical air chamber assembly, 52. The horizontal boot support tubes, 53, are held in place by flanges, 55.

Figure 8:
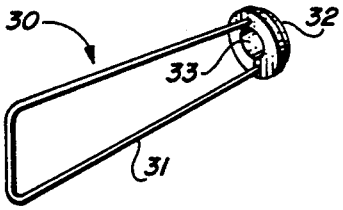

FIG. 8 is a perspective view of an embodiment of a handwear/footwear drying device. The shoulder, 32, fits into hole, 40A, of top, 40, and this item may have either footwear or handwear installed for drying.

Although the invention has been described and illustrated in detail, it is understood that the same is taken by way of illustration and example only and is not to be taken by way of limitation. The spirit and scope of this invention are to be limited only by the terms of the appended claims.

I claim:

1. An apparatus for drying multiple articles of outerwear comprising:

a) a base member having a top surface provided with at least one aperture;

b) air circulation means in said base member to force air through said at least one aperture;

c) outerwear support means having a hollow central member one end of which is profiled to be received in an aperture of said base member and a plurality of hollow arms, said arms in fluid communication with and extending from said central member in a patterned spaced array, each said arm receiving an article of outerwear thereon and directing air therein; and d) a plurality of plug means to close off unoccupied open arm apertures and base member apertures.

2. The apparatus according to claim 1 further comprising:

means to heat said air.

3. The apparatus according to claim 1 further comprising:

means to draw ambient air into said base.

4. The apparatus according to claim 1 wherein said outerwear includes handwear further comprising:

a plurality of drying fittings through which said air passes, each said fitting having a first end adapted to be received in a respective arm end aperture and a second end provided with shape-retaining drying elements.

5. The apparatus according to claim 1 wherein said one end of said central member is provided with means for rotating said central member about its longitudinal axis.

6. The apparatus according to claim 1 wherein said outerwear includes footwear further comprising:

means having a first end received in a respective aperture and a second end receivable within a shoe to both support said shoe and circulate air therethrough.

* * * * *